United States Patent [19]

Nysted

[11] Patent Number: 4,974,618

[45] Date of Patent: Dec. 4, 1990

[54] APPARATUS AND METHOD FOR FABRIC CLEANING WITH FOAM

[75] Inventor: Leonard N. Nysted, Highland Park, Ill.

[73] Assignee: Duraclean International, Inc., Deerfield, Ill.

[21] Appl. No.: 774,168

[22] Filed: Sep. 9, 1985

Related U.S. Application Data

[63] Continuation of Ser. No. 528,605, Aug. 31, 1983, abandoned.

[51] Int. Cl.[5] ..... B08B 5/04

[52] U.S. Cl. ..... 134/21; 134/34; 15/320; 15/321

[58] Field of Search ..... 15/320, 321; 261/DIG. 26; 134/21, 34

[56] References Cited

U.S. PATENT DOCUMENTS

| | | | |
|---|---|---|---|
| D. 239,243 | 3/1976 | Hachtman . | |
| D. 266,962 | 11/1982 | Hachtmann . | |
| 1,596,041 | 8/1926 | Young . | |
| 1,670,934 | 5/1928 | Keefer . | |
| 1,801,135 | 4/1931 | Blogg . | |
| 1,803,693 | 5/1931 | Cutting . | |
| 1,856,510 | 5/1932 | Sandor | 261/DIG. 26 X |
| 1,975,380 | 10/1934 | Streich et al. . | |
| 2,003,215 | 9/1935 | Nadig . | |
| 2,177,987 | 10/1939 | Kelly | 15/321 X |
| 2,198,585 | 4/1940 | Urquhart et al. . | |
| 2,210,846 | 8/1940 | Aghnides . | |
| 2,292,435 | 8/1942 | Crites . | |
| 2,307,082 | 1/1943 | Grotenhuis | 261/DIG. 26 X |
| 2,334,914 | 9/1943 | Erickson . | |
| 2,384,458 | 9/1945 | Dubay | 15/321 X |
| 2,407,408 | 9/1946 | Erickson | 15/320 |
| 2,531,371 | 11/1950 | Thompson | 15/321 |

(List continued on next page.)

FOREIGN PATENT DOCUMENTS

| | | | |
|---|---|---|---|
| 221878 | 1/1957 | Australia . | |
| 568669 | 1/1959 | Canada . | |
| 924064 | 4/1973 | Canada | 15/320 |
| 884912 | 7/1953 | Fed. Rep. of Germany . | |
| 635423 | 5/1962 | Italy . | |
| 618604 | 2/1940 | United Kingdom | 261/DIG. 26 |
| 627285 | 8/1949 | United Kingdom . | |
| 976867 | 12/1964 | United Kingdom . | |
| 1167239 | 10/1969 | United Kingdom . | |
| 1178631 | 1/1970 | United Kingdom . | |
| 1179898 | 2/1970 | United Kingdom . | |
| 1922651 | 12/1970 | United Kingdom | 15/320 |
| 1258875 | 12/1971 | United Kingdom . | |
| 1300680 | 12/1972 | United Kingdom . | |
| 1412348 | 11/1975 | United Kingdom . | |
| 1538507 | 1/1979 | United Kingdom . | |
| 2010081 | 6/1979 | United Kingdom . | |
| 1564150 | 2/1980 | United Kingdom . | |

OTHER PUBLICATIONS

Duraclean Journal, May 1980 (16 pages).

Von Schrader Carpet Deterger specification, copyright 1978, by Von Schrader International, Racine, Wis.

(List continued on next page.)

*Primary Examiner*—Frankie L. Stinson

*Attorney, Agent, or Firm*—Willian Brinks Olds Hofer Gilson & Lione

[57] ABSTRACT

An apparatus and method, particularly adapted to clean fabrics, is disclosed. The apparatus includes a generally hollow head having two foam mixing chambers in close proximity to a vacuum chamber. Foam is generated adjacent the fabric to be cleaned by admixing pressurized air and a liquid foam-producing agent in the two mixing chambers. The air pressure directs the foam from the second mixing chamber towards the fabric. Two screens are used to control the consistency and application of the foam. Suction is simultaneously provided in the vacuum chamber, so that the foam is rapidly and continuously recovered. A brush means is positioned between the second mixing chamber and the vacuum chamber to further agitate the foam and fabric to be cleaned, and to help create a partial pressure when the moving foam is applied to the surface of a fabric.

18 Claims, 9 Drawing Sheets

U.S. PATENT DOCUMENTS

| | | | |
|---|---|---|---|
| 2,556,239 | 6/1951 | Tuve et al. | 261/DIG. 26 X |
| 2,575,675 | 11/1951 | Morgan . | |
| 2,774,583 | 12/1956 | Haftke . | |
| 2,960,710 | 11/1960 | McKeegan | 15/321 X |
| 3,199,790 | 8/1965 | Geismann . | |
| 3,218,657 | 11/1965 | Jepson . | |
| 3,316,579 | 5/1967 | Smith . | |
| 3,344,453 | 10/1967 | Price . | |
| 3,392,418 | 7/1968 | Schowalter . | |
| 3,402,420 | 9/1968 | Schaeffer . | |
| 3,419,082 | 12/1968 | O'Regan et al. | 261/DIG. 26 X |
| 3,530,517 | 9/1970 | Nohl | 15/321 X |
| 3,615,820 | 10/1971 | Herrick | 15/320 UX |
| 3,616,482 | 11/1971 | Brycki . | |
| 3,667,687 | 6/1972 | Rivking et al. | 261/DIG. 26 X |
| 3,686,707 | 8/1972 | Hughes et al. . | |
| 3,699,607 | 10/1972 | Putt . | |
| 3,751,755 | 8/1973 | Smith . | |
| 3,770,209 | 11/1973 | Wilcox . | |
| 3,821,830 | 7/1974 | Sundheim . | |
| 3,843,989 | 10/1974 | DeMaagd . | |
| 4,000,536 | 1/1977 | Nayfa et al. . | |
| 4,083,077 | 4/1978 | Knight . | |
| 4,103,876 | 8/1978 | Hasselman, Jr. et al. | 261/DIG. 26 X |
| 4,158,076 | 6/1979 | Wallsten | 427/294 |
| 4,159,554 | 7/1979 | Knight et al. | 15/321 |
| 4,161,802 | 2/1979 | Knight et al. . | |
| 4,167,799 | 9/1979 | Webb . | |
| 4,330,086 | 5/1982 | Nysted . | |
| 4,360,946 | 11/1982 | Marshall, Jr. et al. . | |

OTHER PUBLICATIONS

The System KleenRite Upholstery, Drapery and Carpet Cleaning System (1982) (Six Sheets).

Mr. Steam Dealer Manual Models 37C and 37CS (undated) (4½pages) by Windsor Industries, Denver, Col.

Mr. Steam Dealer Manual Pilemaster Model PM2 (undated) (2 pages) by Windsor Industries, Denver, Col.

Statement Pursuant to 37 C.F.R. §1.56, 1.97, 1.98 for Nysted U.S. patent application Ser. No. 145,344, filed 4/30/80 (dated 8/1/80).

Supplemental Statement Pursant to 36 CFR §1.56, 1.97, 1.98 for Nysted U.S. patent application Ser. No. 145,344, filed 4/30/80 (dated 8/13/80).

Amendment Under 37 CFR §1.312 and Supplemental Statement Pursuant to 37 CFR §1.99 for Nysted U.S. patent application Ser. No. 145,344, filed 4/30/80 (dated 12/4/81).

FIG. 1
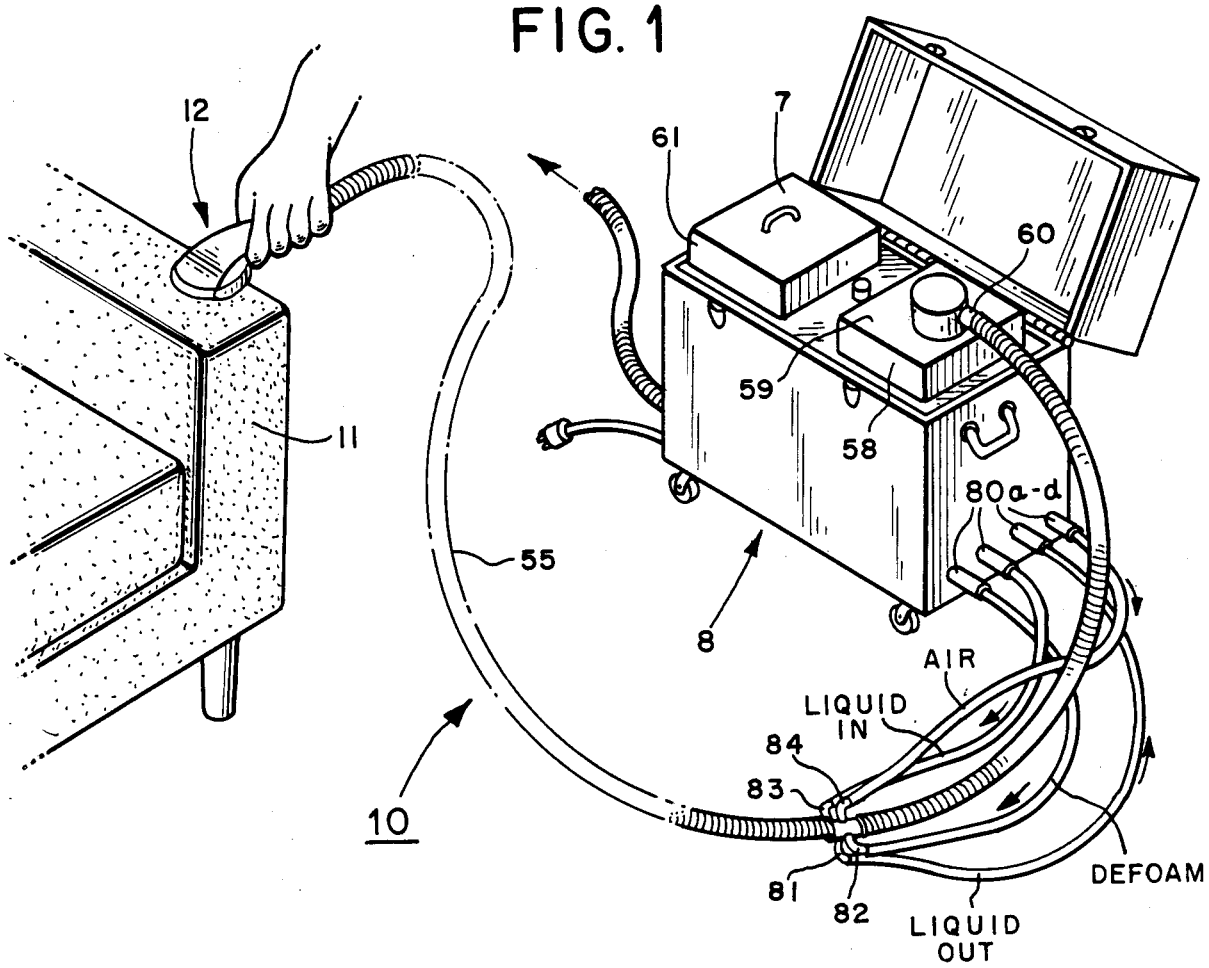
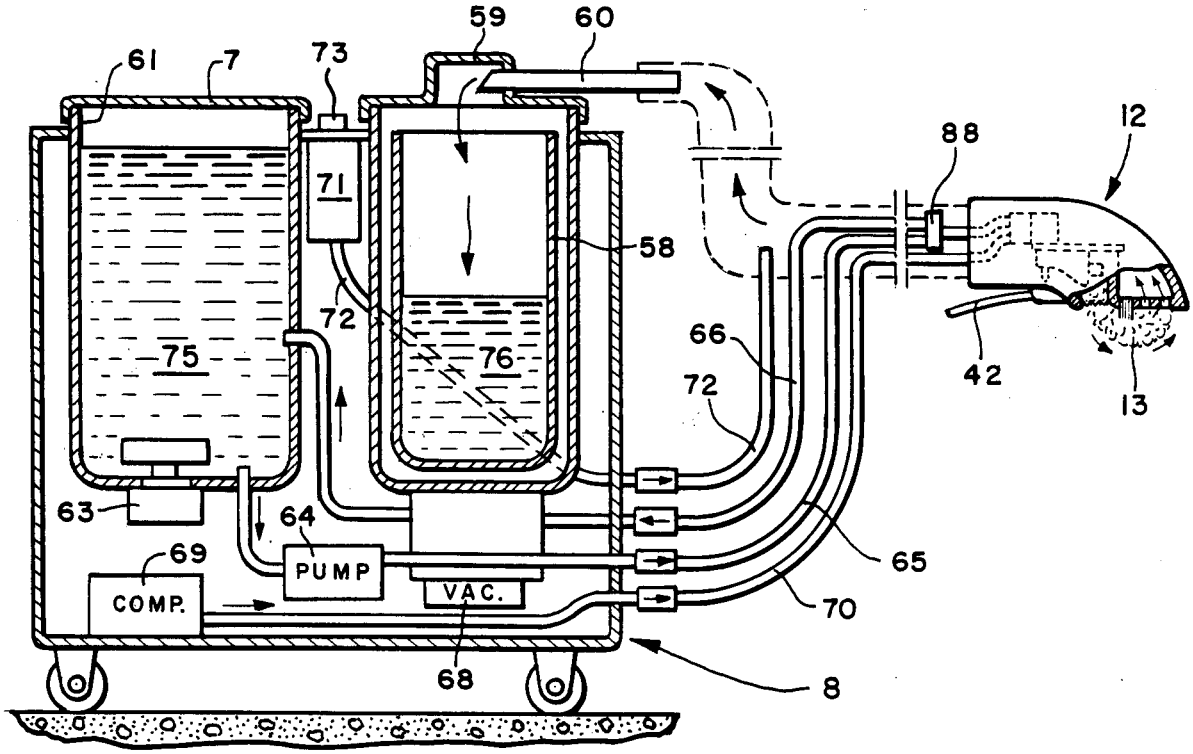
FIG. 5

FIG. 2a
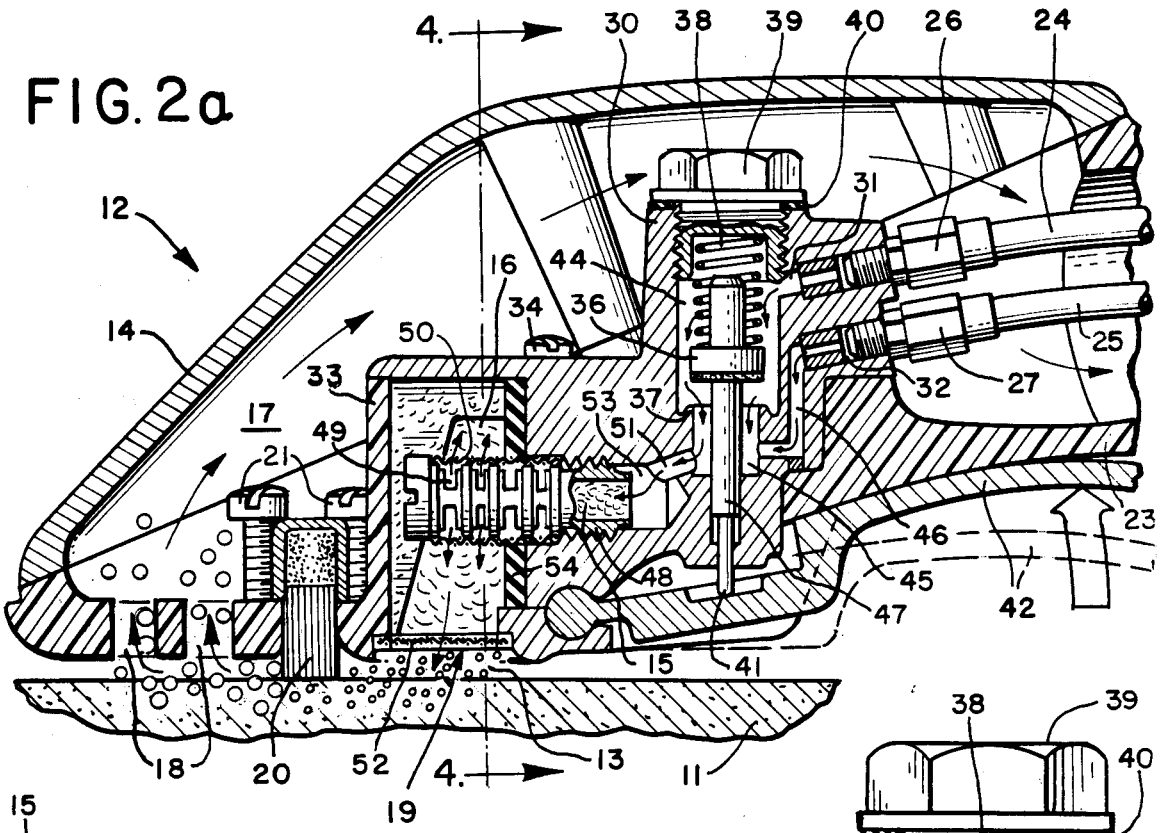
FIG. 2c
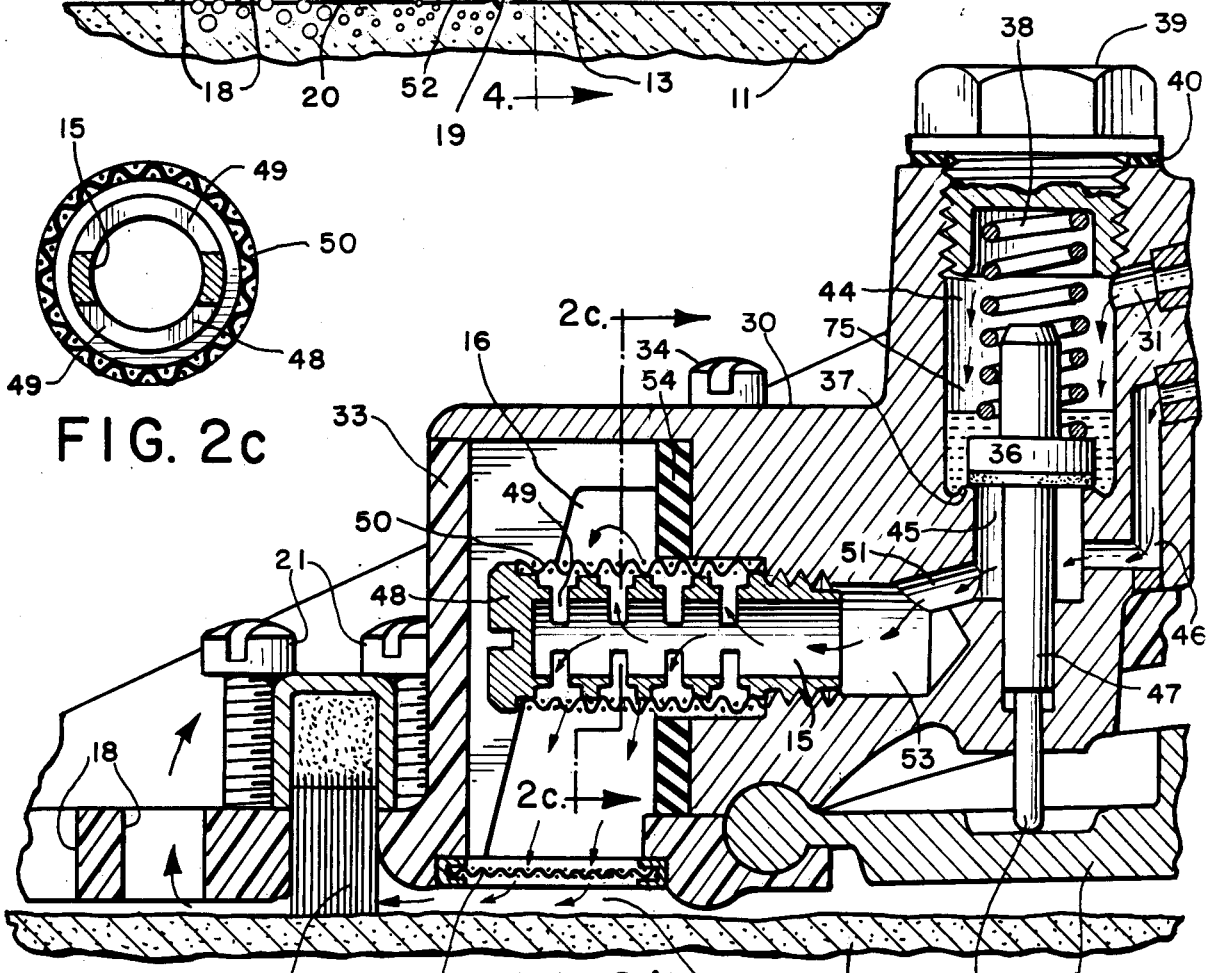
FIG. 2b

FIG. 6
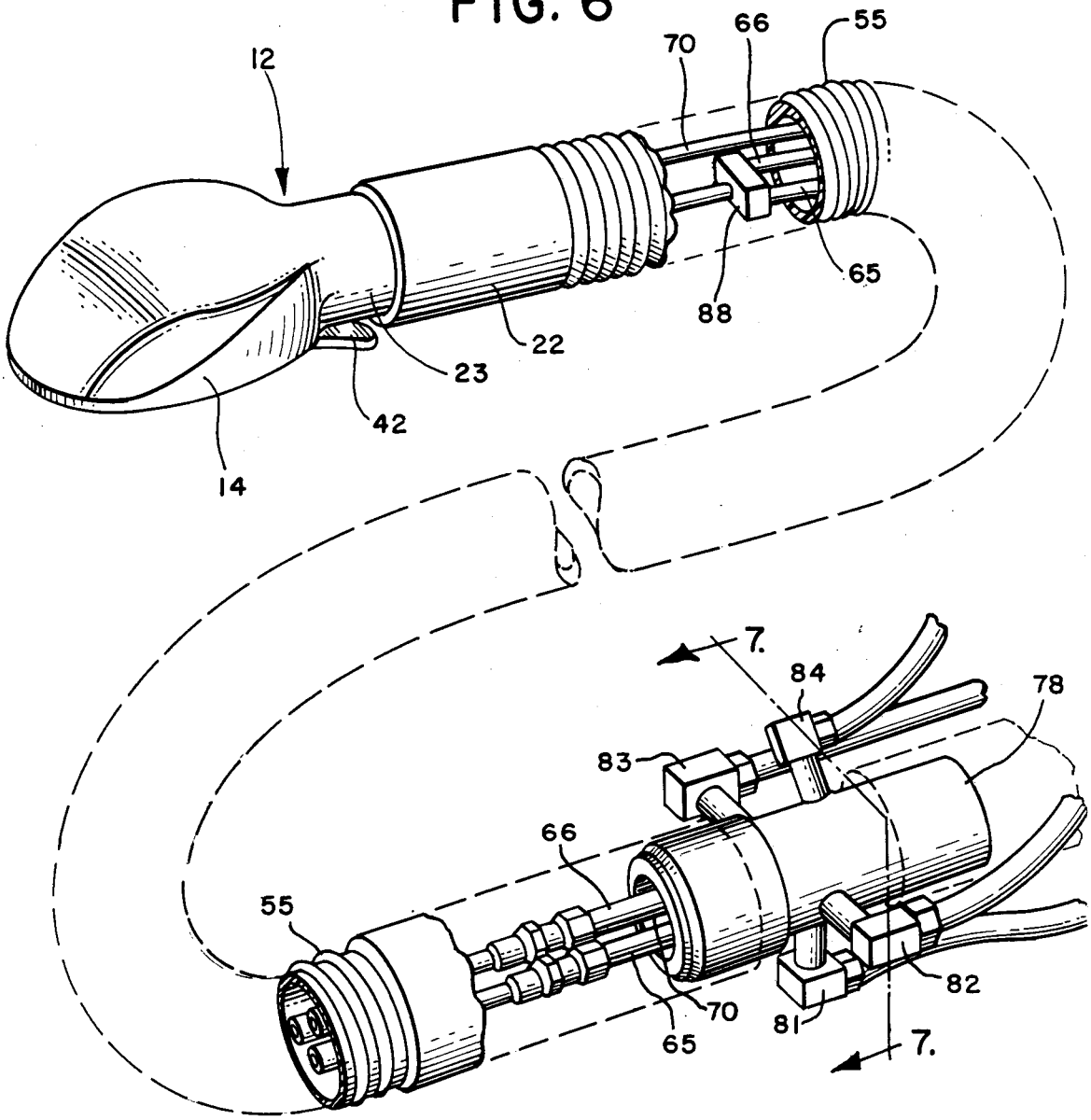
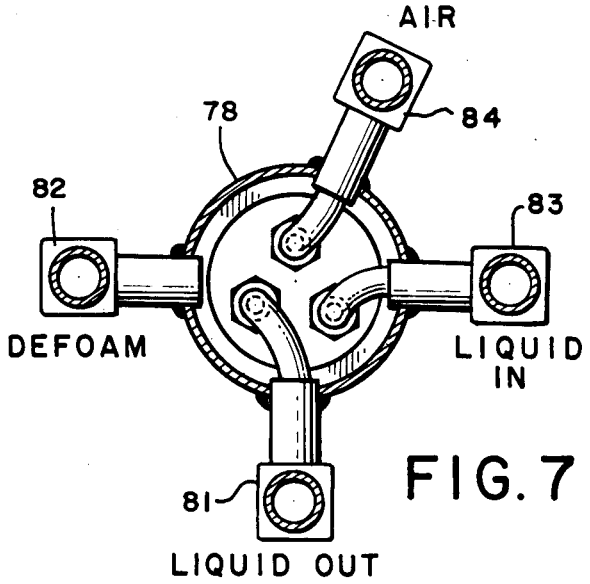
FIG. 7

APPARATUS AND METHOD FOR FABRIC CLEANING WITH FOAM

This application is a continuation of application Ser. No. 528,605, filed Aug. 31, 1983 now abandoned.

BACKGROUND AND SUMMARY OF THE INVENTION

This invention relates to an apparatus and method for cleaning fabric surfaces. More particularly, the invention relates to a method and apparatus for foam cleaning upholstery fabrics.

Foam cleaning agents have been used to clean fabrics, especially carpets, for many years. While it is possible to perform foam cleaning operations manually, it takes less physical exertion and, therefore, is normally preferable to utilize an apparatus which will assure even application and removal of foam along with moderate agitation of the fabric prior to removal of the foam. Many such apparatus have been attempted to remove the foam as soon as possible after application to prevent overwetting the fabric which can result in shrinkage, browning, mildew, and excessive drying times.

The prior designs included for example U.S. Pat. No. 3,392,418 to Schowalter, which discloses a self-contained carpet cleaning apparatus in which foam is generated through the utilization of a pressurized air stream acting upon a detergent feed tube. The detergent is fed to the tube under the force of gravity. The mixture of the air and droplets of detergent produces a foam. The foam is permitted to drop downwardly from a screen, through slots, onto a cylindrical, rotating brush. The brush is disposed transversely across the apparatus, parallel to the floor, so that the rotation of the brush conveys the foam to the carpet and agitates the carpet. The foam is subsequently removed by a vacuum slot positioned to the rear of the brush.

There are several drawbacks with designs such as those disclosed in the Schowalter patent. First, a heavy, bulky machine is only suitable for cleaning carpets and not upholstery and other fabrics. A second disadvantage, even with respect to carpet cleaning, is that the foam is applied to the fabric (i.e. carpet) by means of the rotating brush, which simultaneously agitates the fabric. Not only are the scrubbing brushes often too harsh on many fabrics, including the pile of standard carpets, but the scrubbing action of the brushes drives dirt particles and the foam down deeper into the fabric making recovery more difficult. The deeply penetrated foam dissipates and makes the fabric wetter. These two conditions result in longer drying times and possible overwetting. Finally, the amount of foam that is applied to the carpet is directly related to the speed at which the operator pushes the machine over the carpet. Thus, it is difficult to ensure that an even and consistent layer of foam is applied to the carpet which may result in uneven cleaning of the fabric.

U.S. Pat. No. 3,751,755 to Smith discloses a hand-held, combination vacuum and foam applicator which also has a number of shortcomings in cleaning upholstery fabrics. First, it does not apply the foam and vacuum simultaneously; rather, the foam and vacuum are independently operated at alternate times. Thus, this apparatus is highly susceptible to overwetting while the foam saturates into the fabric during application. Moreover, in this apparatus, the foam is generated remote from the point of application and must be transported a considerable distance to the applicator. It is inherently difficult to maintain the consistency of foam under transport because it tends to collapse during travel.

Due to the above-described problems in the generation, application, and removal of foam from fabrics, especially upholstery, other cleaning devices have been designed that use liquid cleaning agents. These apparatus are commonly referred to in the industry as "steam" cleaners. For example, U.S. Pat. No. 4,083,077 to Knight et al. discloses a hand tool associated with a steam cleaning machine for cleaning carpets as well as upholstery and other fabrics. The hand tool embodies a generally hollow head defining a cleaning agent chamber with a bottom opening and a vacuum chamber with a bottom opening positioned forward of the cleaning agent chamber. The operator squeezes the trigger to release a fluid solution to the cleaning agent chamber where it is sprayed into the pile of the underlying fabric. As the operator pulls the hand tool in the direction of the cleaning agent chamber, suction from the vacuum chamber is applied to remove the moisture previously sprayed onto the fabric.

One disadvantage of such a steam cleaning system is that the fluid spray exerts virtually no force to the fabric pile to loosen embedded soil to be removed, save for its initial momentum of the spray. Moreover, an inherent problem with steam cleaning systems is overwetting. When cleaning liquid is brushed, sprayed, or otherwise deposited on a fabric, it tends to penetrate deeply into the pile. Once the cleaning liquid has penetrated into the fabric, it is difficult to remove. Also, in passing through the upper layers of the fibers, the liquid tends to absorb dirt and carry it down to the lower layers, where it remains. This minimizes the amount of dirt that can actually be removed from the carpet, and can result in color running, shrinkage, mildew and browning. Another shortcoming of all liquid (steam) cleaning operations is that they require substantial drying times, which is a serious disadvantage, particularly in commercial establishments.

In addition to being subject to all the aforementioned problems of steam cleaning systems, the apparatus disclosed in the Knight patent is also prone to localized overwetting around the edges of an upholstered object. That is, where the liquid spray precedes the suction over the edge of a surface, areas on adjacent surfaces of the object will be wetted but will not be vacuumed.

The present invention responds to the drawbacks and limitations of the prior art by providing a fabric cleaning apparatus which generates foam in one end of the apparatus and directs it toward the fabric to be cleaned. In the preferred embodiment of the invention, the foam is generated by admixing pressurized air and a cleaning solution in the apparatus adjacent to the point of application. The pressurized air also directs the foam towards the fabric. A vacuum is simultaneously provided at the other end of the apparatus, such that it cooperates with the inertia of the foam to move the foam rapidly and continuously between the ends of the apparatus and effectively to produce a continuous belt of foam between the two ends. It is preferred to position a stationary brush between the two ends so that the moving foam passes over and through the bristles of the brush. When the apparatus is applied to a fabric to be cleaned, the foam moves in immediate contact with the fabric, and a partial pressure is created that enhances the agitating action of the foam.

Thus, in the present invention, the rapidly, continuously moving foam, under partial pressure, in immediate contact with the surface of the fabric overcomes many of the disadvantages of the prior art. Specifically, the force of the moving foam erodes and suspends embedded soil instantly, thereby providing improved cleaning. The stationary brush cooperates with the moving foam to further agitate the fabric and foam but without the harsh effect on the fabric of a rotating brush. Moreover, the foam moves rapidly through the horizontal plane of the fabric so that it does not penetrate deeply into the pile of the fabric. This affords easy removal of the foam and minimizes overwetting. Also, a more consistent foam is applied to the fabric because the foam is generated by admixing pressurized air and a cleaning solution in the apparatus adjacent to the point of application.

These and other features and advantages of the present invention will be apparent from the following description, appended claims, and annexed drawings.

BRIEF DESCRIPTION OF THE DRAWINGS

FIG. 1 is a perspective view of one embodiment of the present invention;

FIG. *2a* is a longitudinal sectional view of a hand tool embodying the present invention with its valve in the open position;

FIG. *2b* is an enlarged, sectional view of a hand tool embodying the invention with its valve in the closed position;

FIG. *2c* is a sectional view taken along line *2c–2c* of FIG. *2b;*

Figure 3:
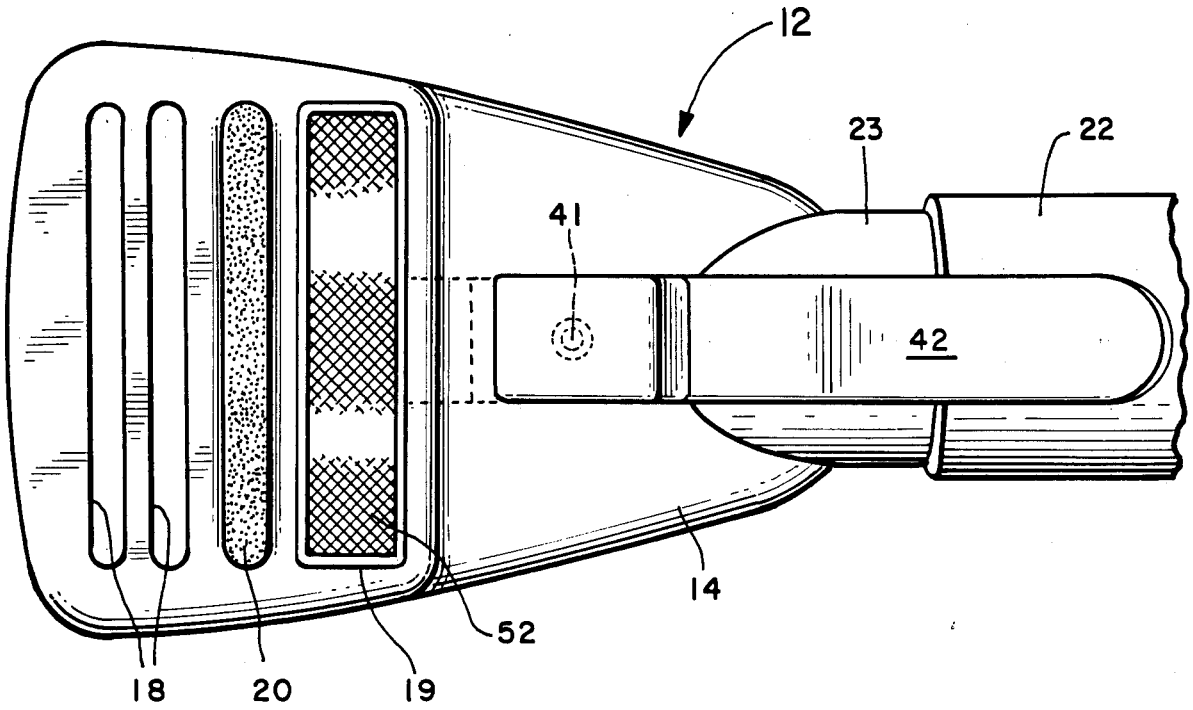

FIG. 3 is a view of the underside of the hand tool of FIG. *2b;*

Figure 4:
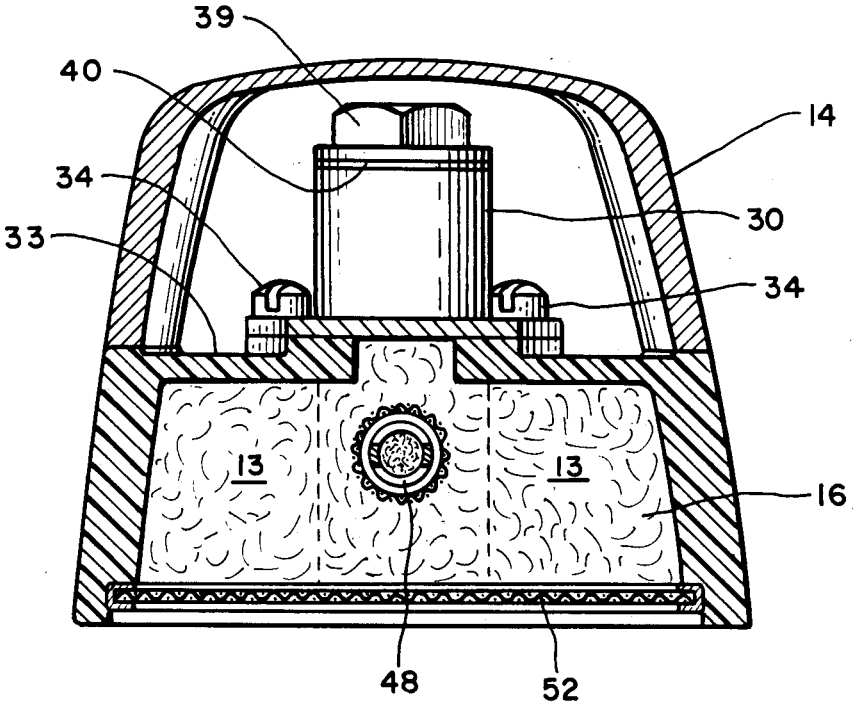

FIG. 4 is a sectional view taken along line 4—4 of FIG. *2a;*

FIG. 5 is a schematic representation of an auxiliary machine that may be used in conjunction with the invention;

FIG. 6 is an enlarged perspective view, partly in exploded form, of a recirculating system used in the preferred embodiment of the invention; and FIG. 7 is a sectional view taken along line 7—7 of FIG. 6.

DETAILED DESCRIPTION OF THE PREFERRED EMBODIMENT

The principles of this invention are particularly useful when embodied in an upholstery cleaning apparatus such as that illustrated in the FIGS. 1 and *2a–c*, generally depicted by the numeral 10. The cleaning apparatus 10 includes a fabric cleaning tool 12 which is designed to apply a cleansing foam to the upholstery 11 and subsequently to remove the foam with the dirt released in the cleaning operation. In the preferred embodiment, the cleaning tool 12 is designed to be hand operated, and is especially suited for cleaning upholstery. Nevertheless, it should be understood that the present invention is also suitable for cleaning other fabrics, such as carpets, even in its preferred embodiment.

As shown in FIGS. *2a*, 3 and 4, the cleaning tool 12 comprises a generally hollow head 14 that is attached at its neck 23 to the cuff 22 of a vacuum hose 55. The external design of the head 14 is generally constructed :n accordance with the hand-tool cleaning head disclosed in U.S. Pat. No. 4,083,077 issued to Knight, et al., although the internal construction of the head 14 differs significantly from that of the Knight cleaning head. The external design of the head disclosed in the Knight patent is particularly well suited for cleaning upholstery. The entire disclosure of the Knight patent, and in particular as it relates to the exterior construction of the cleaning head as shown in FIGS. 2, 4 and 5 of the Knight patent, is hereby incorporated by reference as a part of this application.

Located within the head 14 are a first mixing chamber 15 and a second mixing chamber 16 at the back end of the head and a vacuum chamber 17 at the front end of the head. The bottom of the head 14 is provided with two vacuum intake slots 18 which lead into the vacuum chamber 17, a foam output slot 19, and a plurality of stationary brush bristles 20 which are secured to the head 14 by screws 21.

As shown in FIG. *2a*, foam 13 is generated in the two mixing chambers and directed from the second mixing chamber 16 through the foam output slot 19 towards the upholstery 11 to be cleaned. The vacuum chamber 17 is provided with sufficient suction to draw the foam towards and through the vacuum intake slots 18. Due to the close proximity of the intake slots 18 and the foam output slot 19 and to the suction in the vacuum chamber 17, the foam is continuously and rapidly moved from the output slot 19 to the intake slots 18.

The brush 20 serves to force the moving foam over the top of the bristles and towards the fabric, thereby creating a continuous wheel of foam between the intake slots 18 and output slot 19. In the present embodiment, the brush is made of soft nylon bristles. It should be understood that the brush may be made of any suitable material, although it is preferred that the bristles are sufficiently pliable so that the foam also passes between the bristles when the apparatus is applied to the fabric. Thus the foam is not forced around the sides of the brush.

In the preferred embodiment, the foam 13 is generated by admixing pressurized air and a liquid foam-producing cleaning solution. A solution input conduit 24 and an air input conduit 25 enter the head 14 through the neck 23. Conduits 24 and 25 are connected to inlet fixtures 26 and 27, respectively, and these fixtures are threaded into orifices 31 and 32, respectively, of a valve housing 30. The valve housing 30 is attached to a support 33 of the head 14 by screws 34. Within the valve housing 30, a valve 36 is forced towards a valve seat 37 by a spring 38. The spring is secured within a reservoir 44 of the valve housing 30 by a bolt 39 and washer 40.

The cleaning solution is delivered under pressure via conduit 24 to the reservoir 44. When the lever 42 is in its rest position, as shown in FIG. *2b*, the cleaning solution 75 is trapped within the reservoir 44. Air is delivered under pressure via conduit 25 to orifice 32 of the valve housing. A passage 46 is provided within the valve housing 30 to allow the pressurized air to pass through the valve housing to a reservoir 45. The diameter of the valve stem 47 of the valve 36 is small enough to allow the air to travel through the reservoir 45 and into the first mixing chamber 15 via a passage 51. The air is then forced through the slots 49 and a first screen 50 into the second mixing chamber 16 and out of the head 14 via the output slot 19 and a second screen 52. Thus, there is always a continuous flow of pressurized air through the valve housing and mixing chambers. This continuous flow of pressurized air is preferred because it minimizes the erratic generation of foam and spurting.

The first mixing chamber 15 :s defined by an orifice 53 and the inner walls of a hollow cylinder 48, which is threaded into the valve housing 30 and extends into the second mixing chamber 16. The cylinder 48 is provided with a series of circumferential slots 49 which allow the foam generated in the first mixing chamber 15 to be expressed into the second mixing chamber 16. The first screen 50 is cylindrical in shape, and covers the slots 49 to regulate the consistency of the foam. A neoprene gasket 54, through which the cylinder 48 passes, is provided between the valve housing 30 and second mixing chamber 16. This gasket serves to prevent leakage between the second mixing chamber 16 and the vacuum chamber 17 as such leakage would diminish the suction in the vacuum chamber.

The second screen 52 covers the foam output opening 19 at the bottom of the second mixing chamber 16. This screen further controls the consistency of the foam to provide uniform bubble size and density, and assures even application of the foam to the upholstery 11. In the preferred embodiment, the mesh of the second screen 52 is finer than the mesh of the first screen 50 in order to improve the consistency of the foam generated.

When the lever 42 is pulled towards the neck 23 of the head 14, as shown in FIG. *2a*, it engages the trigger pin 41 of the valve 36 to push the valve away from the valve seat 37. The cleaning solution stored in reservoir 44 is then forced down into reservoir 45 by the pressure of the incoming solution in conduit 24. In the preferred embodiment, the free flowing pressurized air in passage 46 contacts the solution in reservoir 45 perpendicularly in order to enhance admixture of the two. The pressurized air forces the solution into the first mixing chamber 15 where they thoroughly admix to create a bubbled foam. This foam is then expressed through the slots 49 and first screen 50 into the second mixing chamber 16 where it further admixes with the additional air always present in the second mixing chamber. The force of the pressurized air input to the reservoir 45, in addition to admixing with the solution to generate foam, also propels the foam through the first mixing chamber 15, the second mixing chamber 16, and the second screen 52 towards the upholstery 11.

The pressure under which the air and cleaning solution are delivered to the reservoir 45 can be adjusted to control the consistency of the foam generated. By generating foam in the above described manner, a dry foam of uniform consistency can be achieved. The dryness of the foam can be controlled so that it is wet enough to clean the fabric yet not saturate. This will result in better recovery of the foam and quicker drying times. Moreover, by generating the foam in the mixing chambers adjacent the fabric to be cleaned, the consistency of the foam does not deteriorate during transit.

Referring now to FIGS. 1 and 5, the fabric cleaning tool 12 is connected by the vacuum hose 55 to a cleaning machine 8. The cleaning machine 8 includes a dispensing tank 61 and a recovery tank 58. The dispensing tank holds a cleaning solution 75 and includes a lid 7. A thermostatically controlled heater 63 heats the cleaning solution 75. The temperature of the cleaning solution is raised to improve its cleaning efficiency. The heated cleaning solution is pumped from the dispensing tank 61 via a pump 64. The pump forces the solution through a delivery line 65, under pressure, to the orifice 31. The solution is recycled via a return line 66.

A vacuum 68 provides sufficient suction in the vacuum hose 55 to rapidly and continuously recover the foam generated at the foam output slot 19 travelling across the upholstery 11 and into the vacuum intake slots 18 so that the acceleration of the foam across the fabric surface erodes and suspends embedded soil into the foam. The suction created by the vacuum 68 further serves to transport the soiled foam through the hollow cavity of the head 14 and the vacuum hose 55 to the recovery tank 58. The recovery tank 58 includes a lid 59 and an inlet sleeve 60.

The cleaning machine 8 is also equipped with a compressor 69 which provides pressurized air to the orifice 32. The compressor 69 and pump 64, as well as the size of the orifices 31 and 32, can be adjusted to control the pressure under which the air and solution are delivered to the orifices 31 and 32, thereby controlling the consistency of the foam generated.

The cleaning machine 8 also includes a reservoir 71 containing a defoaming agent which is mixed with the soil-laden foam in the vacuum hose 55 and converts it to a liquid. The soiled liquid 76 is then removed from the vacuum hose 55 and stored in the recovery tank 58. The foam destroyer reservoir 71 is provided with a foam destroyer valve 73 which meters the amount of defoaming agent that is mixed with the soiled foam so as to afford liquifaction.

The heated cleaning solution, pressurized air, and defoaming agent are conveyed from the cleaning machine 8 via the delivery lines 65, 25, and 72, respectively. The solution return line 66 recycles the cleaning solution 75 to the dispensing tank 61. These lines are connected to the cleaning machine 8 by use of conventional quick-connect fasteners 80 *a–d*. The delivery and return lines run outside the vacuum hose 55 between the fasteners 80 *a–d* and the solution inlet fixture 83, the solution outlet fixture 81, the air inlet fixture 84, and the defoamer inlet fixture 82, respectively. These inlet and outlet fixtures are shown in FIGS. 6 and 7 circumferentially spaced and radially extending from the stationary sleeve 78. The solution delivery and return lines 65 and 66 run longitudinally within the vacuum hose 55 between the fixtures 83 and 81 and the block member 88. The block member 88 is also connected to the solution input conduit 24 which leads to the valve housing 30.

The solution delivery and return lines 65 and 66, the solution inlet and outlet fixtures 83 and 81, and the block member 88, together with the pump 64, cooperate to provide a fluid recirculating system as described in U.S. Pat. No. 4,159,554 issued to Knight, et al. The entire disclosure of the Knight patent is incorporated by reference into this application for the description of its recirculating system, in particular with respect to FIGS. 1, 2 and 4 of the Knight patent. In the present system, a portion of the heated cleaning solution 75 is recirculated by the solution delivery and return lines 65 and 66 within the vacuum hose 55, with another portion passing directly to the solution input conduit 24 for foam generation as needed. With this type of arrangement, the temperature drop of the cleaning solution delivered to the block member 88 from the temperature of the fluid in the dispensing tank 61 is greatly reduced.

Referring now to FIGS. *2a*, 6, and 7, it is seen that the air input conduit 25 also runs longitudinally within the vacuum hose 55 between the air inlet fixture 84 and the orifice 32. The defoamer delivery line 72 terminates at the defoamer inlet fixture 82, thereby introducing the defoaming agent into the vacuum hose at this point. It is preferable to perform the defoaming process in the vacuum hose 55 well before the recovery tank 58 to maintain maximum vacuum.

The operation of the fabric cleaning tool 12 and the cleaning machine 8 will now be described. First, the heater 63, compressor 69, pump 64, and vacuum 68 must all be energized. This may be done by a conventional electrical connection, and a series of switches may be provided for this purpose so that they all may be energized collectively or independently. Prior to energization, however, the operator should make sure that a sufficient amount of cleaning solution 75 is retained in the dispensing tank 61, and that defoaming agent is retained in the foam destroyer reservoir 71. At this time, the recovery tank 58 should be empty.

Once the above conditions have been monitored, and power has been supplied to all the elements, the pump 64 will begin recirculating the heated cleaning solution 75 through the solution delivery and return lines 65 and 66. A portion of this cleaning agent will pass into the solution input conduit 24 via the block member 88. The cleaning solution in conduit 24 will then proceed to fill reservoir 44 of the valve housing 30, as shown in FIG. 2*b*. At the same time, the vacuum 68 will create a suction in the vacuum hose 55 and vacuum chamber 17, and the compressor 69 will force air to orifice 32 of the valve housing 30. The pressurized air will be forced through passage 46, reservoir 45, passage 51, the first mixing chamber 15, the slots 49, the first screen 50, the second mixing chamber 16, and finally through the bottom opening 19 of the head 14 via the second screen 52.

To initiate the generation of foam, the operator depresses lever 42, which controls the delivery of the cleaning solution to the first mixing chamber. As shown in FIG. 2*a*, this causes the valve 36 to open and allow the cleaning solution 75 in reservoir 44 to flow into reservoir 45. The forced air flowing from passage 46 contacts the cleaning solution in reservoir 45 perpendicularly and forces it through passage 51 into the first mixing chamber 15. The pressurized air and cleaning solution admix with the additional air present in the first mixing chamber 15 to generate foam bubbles. The force of the incoming pressurized air expresses this foam through the slots 49 and the first screen 50 into the second mixing chamber 16. The first screen controls the consistency of the foam. The foam is further admixed with the air that is always present in the second mixing chamber 16 and expands to fill the entire chamber, as shown in FIG. 4. The constant force of the free-flowing pressurized air expels the foam 13 from the second mixing chamber 16 through the second screen 52 and the foam output opening 19 towards the upholstery 11.

The suction created in the vacuum chamber 17 accepts the foam 13 expelled from the output slot 19 via the vacuum intake slots 18 so that the foam moves rapidly and continuously between the output slot 19 and intake slots 18. The brush 20 forces most of the moving foam 13 over the tips of the brush, although the bristles also allow some of the foam to pass between them. Thus, a continuous, rapidly moving wheel of foam is generated between the output slot 19 and the intake slots 18.

When the bottom of the cleaning head 14 is applied to the surface of the upholstery 11, a compression is created between the back side of the brush 20 and the output slot 19 which causes the bubble size of the foam 13 to decrease, as shown in FIG. 2*a*. This partial pressure is caused by resistance to the flow of the moving foam, which is caused by the introduction of the foam to the fabric surface and by the resistance provided by the brush 20 when it is compressed against the fabric. The vacuum provided from the vacuum chamber 17 creates a decompression between the front side of the brush 20 and the intake slots 18. Thus, a compression and a decompression are created on opposite sides of the brush. The brush 20, however, in addition to providing resistance to the flowing foam, is also sufficiently permeable so that the foam moving under partial pressure may pass through the brush to the decompression created by the vacuum. Thus, the brush affords a pressure variance across the brush, from the partial pressure at its back side to the decompression at its front side, to contain the flow of the moving foam through the brush. In contrast, if no brush were provided between the foam output slot 19 and the vacuum intake slots 18, the foam would pass directly from the compression, created by the introduction of the moving foam against the fabric surface, to the decompression, created by the vacuum. Or if an impermeable barrier were provided between the output slot 19 and intake slots 18, all the foam moving under partial pressure would be forced around the edges of the barrier. It should be understood that while the brush 20 is the preferred way of creating a partial pressure and a pressure variance across the brush, other means may be used similarly to create a partial pressure and pressure variance.

The smaller foam bubbles resulting from the partial pressure allow the bubbles to accelerate more quickly along the surface of the fabric in a horizontal direction, thereby increasing the agitating effect of the foam without deep vertical penetration. When the bubbles reach the other side of the brush, they encounter the decompression which causes their size to expand. Nevertheless, the suction in the vacuum chamber 17 removes these foam bubbles from the fabric via the intake slots 18. The suction continues to draw the soil-laden foam through the hollow cavity of the cleaning head 14 and the vacuum hose 55. The defoaming agent converts the foam to a liquid in the vacuum hose at the defoamer inlet fixture 82. The soiled liquid 76 is removed from the hose 55 by the suction and is delivered to the recovery tank 58.

In the present invention, the continuously rapidly moving foam, under partial pressure, in immediate contact with the surface of the fabric, erodes and suspends embedded soil instantly. Moreover, since the foam is rapidly moving in the horizontal plane of the fabric, it does not penetrate deeply into the pile of fabric. Thus, it is easily removed by the suction of the vacuum chamber 17 and does not overwet the fabric. The brush 20 cooperates with the rapidly moving foam to further agitate the fabric and foam to release and suspend dirt into the moving foam, yet does not have the harsh effect on fabrics of a rotating brush. To provide further, moderate agitation, it is preferable that the operator move the cleaning tool 12 in short, vigorous strokes over the surface of the fabric to be cleaned. It is also preferable that after the fabric has been foam cleaned, as previously discussed, the cleaning tool 12 be operated with only the vacuum to remove any excess moisture that is removable.

Of course, it should be understood that various changes and modifications of the preferred embodiment described herein will be apparent to those skilled in the art. Such changes and modifications can be made without departing from the spirit and scope of the present invention and without diminishing its attended advantages. It is, therefore, intended that such changes and modifications be covered in the following claims.

I claim:

1. In a fabric cleaning apparatus having a generally hollow head defining a cleaning agent chamber with a bottom opening for applying a cleaning agent to a fabric to be cleaned, and a vacuum chamber with a bottom opening positioned forward of the cleaning agent chamber for generating suction to remove the cleaning agent from the fabric, the improvement comprising:

the cleaning agent chamber having a first mixing chamber and a second mixing chamber, the second mixing chamber including the bottom opening of the cleaning agent chamber;

means for providing a cleaning solution to the first mixing chamber;

means for providing pressurized air to the first mixing chamber;

means for controlling the delivery of the cleaning solution and pressurized air to the first mixing chamber so that the cleaning solution and pressurized air admix to generate foam;

first screen means, adjacent the first mixing chamber through which the foam is expressed into the second mixing chamber, for regulating the consistency of the foam;

second screen means, adjacent the bottom opening of the second mixing chamber through which the foam is expelled towards the fabric to be cleaned, for the regulating the consistency of the foam;

a plurality of non-rotating brush bristles positioned between the second mixing chamber bottom opening and the suction chamber bottom opening; and the suction and pressurized air cooperating, when the bottom of the head is applied to a fabric, to move the foam rapidly and continuously under partial pressure from the second mixing chamber bottom opening, across the fabric, between and over the brush bristles, and into the vacuum chamber bottom opening so that the rapidly moving foam and brush bristles combine to agitate, release, and suspend dirt from the fabric into the foam which is removed by the suction.

2. The invention of claim 1 wherein the cleaning solution is provided to the first mixing chamber in a direction perpendicular to the direction in which the pressurized air is provided to the same chamber.

3. The invention of claim 1 wherein the first screen means is cylindrical in shape.

4. A fabric cleaning apparatus having front and back ends comprising:

means, adjacent one of the ends, for continuously generating foam with positive pressure;

means for continuously propelling the foam under positive pressure from the foam generating means out of the cleaning apparatus towards the fabric to be cleaned;

vacuum means, adjacent the other end, for continuously and concurrently removing foam from the fabric; and the propelling means and vacuum means cooperating to move the foam rapidly and continuously between the front and back ends of the apparatus without rotating brush means and, when the moving foam is continuously applied to the surface of a fabric, foam bubbles will compress under the positive pressure applied by the propelling means and resistance provided by the fabric, and expand under the vacuum means, so that the foam moves across the fabric rapidly, continuously, and under partial pressure.

5. The invention of claim 4 wherein the foam generating means includes means for admixing pressurized air and a cleaning solution to generate foam.

6. A fabric cleaning apparatus having front and back ends comprising:

means, adjacent one of the ends, for continuously generating foam under positive pressure;

suction means, adjacent the other end, for continuously and concurrently removing foam from the fabric to be cleaned;

stationary brush means positioned between the foam generating means and the suction means;

means for continuously propelling the foam under positive pressure from the foam generating means out of the cleaning apparatus towards the fabric to be cleaned and the brush means; and the propelling means and suction means cooperating to move the foam rapidly and continuously between the front and back ends of the apparatus and, when the moving foam is continuously applied to the surface of a fabric, foam bubbles will compress under the positive pressure provided by the propelling means and the resistance to the moving foam provided by the fabric and brush means, and will expand under the suction means, so that the foam moves across the fabric and over and through the brush means rapidly, continuously, and under partial pressure.

7. The invention of claim 6 wherein the foam generating means includes means for admixing pressurized air and a cleaning solution to generate foam.

8. A fabric cleaning apparatus having front and back ends comprising:

means for supplying pressurized air;

means for supplying a cleaning solution;

continuous foam generating means, adjacent one of the ends, for continuously admixing the pressurized air and cleaning solution to continuously generate foam under positive pressure and for continuously propelling the foam under positive pressure out of the cleaning apparatus towards the fabric to be cleaned and a stationary brush means;

vacuum means, adjacent the other end, for continuously and concurrently removing foam from the fabric to be cleaned;

the stationary brush means positioned between the foam generation means and the vacuum means; and the vacuum means cooperating with the foam generation means to move the foam rapidly and continuously between the front and back ends of the apparatus and, when the moving foam is continuously applied to the surface of a fabric, foam bubbles compress under the positive pressure of the continuously generated and propelled foam and the resistance to moving foam provided by the fabric and the brush means, and will expand under the vacuum means, so that the foam moves across the fabric and over and through the brush means rapidly, continuously, and under partial pressure.

9. The invention of claim 8 wherein the foam generating means includes a first mixing chamber.

10. The invention of claim 9 wherein the foam generating means includes a second mixing chamber having an opening through which the foam is propelled towards the fabric to be cleaned.

11. The invention of claim 10 wherein the first mixing chamber is cylindrical in shape.

12. The invention of claim 8 wherein the foam generating means includes a first screen for controlling the consistency of the foam.

13. The invention of claim 12 wherein the foam generating means includes a second screen for controlling the consistency of the foam.

14. The invention of claim 8 further comprising means for adjusting the pressurized air supply means and cleaning solution supply means.

15. In a hand-held fabric cleaning apparatus having a generally hollow head defining a cleaning agent chamber with a bottom opening for applying a cleaning agent to a fabric to be cleaned, and a vacuum chamber with a bottom opening positioned forward of the cleaning chamber for generating suction to remove the cleaning agent from the fabric, the improvement comprising:

means for providing a cleaning solution to the cleaning agent chamber;

means for providing pressurized air to the cleaning agent chamber;

continuous foam generation means for controlling the delivery of the cleaning solution and pressurized air to the cleaning agent chamber so that the cleaning solution and pressurized air continuously admix to continuously generate foam under positive pressure and for continuously propelling the foam under positive pressure out of the cleaning agent bottom opening towards the fabric to be cleaned and a stationary brush means;

the stationary brush means positioned between the cleaning agent chamber bottom opening and the vacuum chamber bottom opening;

the vacuum chamber continuously and concurrently providing suction to remove foam from the fabric to be cleaned; and the suction cooperating with the foam generation means to move the foam rapidly and continuously between the cleaning agent chamber bottom opening and the vacuum chamber bottom opening and, when the moving foam is continuously applied to the surface of a fabric, foam bubbles will compress under the positive pressure of the continuously generated and propelled foam and the resistance to moving foam provided by the fabric and brush means, and will expand under the suction of the vacuum chamber, so that the foam moves across the fabric and over and through the brush means rapidly, continuously, and under partial pressure.

16. A method for cleaning fabric comprising:

continuously generating foam under positive pressure at a point adjacent to the fabric to be cleaned;

continuously propelling the foam under positive pressure against the fabric to be cleaned so that foam bubbles compress against the fabric under the positive pressure;

continuously and concurrently removing the foam from the fabric by suction so that the foam bubbles expand under the negative pressure of the suction; and moving the foam rapidly and continuously across the surface of the fabric between the point of foam generating and suction and under partial pressure resulting from the continuous positive pressure on the foam and the suction, and without rotating brush means.

17. The invention of claim 16 wherein the foam generating step includes admixing pressurized air and cleaning solution in a chamber adjacent the fabric to be cleaned.

18. The invention of claim 16 wherein the moving step includes moving the foam over and through a stationary brush positioned between the point of foam generation and suction.

* * * * *

UNITED STATES PATENT AND TRADEMARK OFFICE

CERTIFICATE OF CORRECTION

PATENT NO. : 4,974,618

DATED : December 4, 1990

INVENTOR(S) : Leonard N. Nysted

It is certified that error appears in the above-identified patent and that said Letters Patent is hereby corrected as shown below:

In column 6, line 23, please delete "liquifaction" and substitute therefor --liquefaction--

In column 9, line 30 (claim 1, line 27), before "regulating" please delete "the".

In column 10, line 39 (claim 8, line 5), please delete "generating" and substitute therefor --generation--.

Signed and Sealed this

Seventeenth Day of November, 1992

*Attest:*

DOUGLAS B. COMER

*Attesting Officer*

*Acting Commissioner of Patents and Trademarks*